United States Patent [19]

Rosenthal et al.

[11] Patent Number: 4,781,336

[45] Date of Patent: Nov. 1, 1988

[54] APPARATUS FOR UNWINDING AND FEEDING MATERIAL INTO A SHEETING MACHINE

[75] Inventors: Ben J. Rosenthal, Wilmette; Gregory Starikovsky, Glenview, both of Ill.

[73] Assignee: Rosenthal Manufacturing Co., Inc., Chicago, Ill.

[21] Appl. No.: 937,314

[22] Filed: Dec. 3, 1986

[51] Int. Cl.[4] ..... B65H 16/00

[52] U.S. Cl. ..... 242/58.6; 242/68.4; 242/75.41

[58] Field of Search ..... 242/58.6, 75, 75.4, 242/68.4, 75.41, 67.1R, 67.3 R, 55

[56] References Cited

U.S. PATENT DOCUMENTS

| | | | |
|---|---|---|---|
| 1,735,570 | 11/1929 | Halliwell | 242/75.41 |
| 1,736,834 | 11/1929 | Ogden | 242/75.41 |
| 1,819,586 | 8/1931 | Ball | 242/75.41 |
| 2,533,782 | 12/1950 | Fischer | 242/156.2 |
| 2,668,705 | 2/1954 | Rosenthal | 226/135 |
| 2,877,963 | 3/1959 | Hayden | 242/156 |
| 3,076,618 | 2/1963 | Van Hook | 242/75.42 |
| 3,177,748 | 4/1965 | Rosenthal | 83/171 |
| 3,299,756 | 1/1967 | Rosenthal | 83/98 |
| 3,388,623 | 6/1968 | Rosenthal | 83/98 |
| 3,844,502 | 10/1974 | Toy, Jr. | 242/67.1 R |
| 4,441,664 | 4/1984 | Stohlquist | 242/75.42 |
| 4,638,957 | 1/1987 | Graves | 242/58.6 |

*Primary Examiner*—David Werner

*Attorney, Agent, or Firm*—Neuman, Williams, Anderson & Olson

[57] ABSTRACT

A sheeting machine having an improved apparatus for unwinding and feeding sheet material which includes a support frame; pivotally connected vertical support members; and tapered lateral support members. The lateral support members provide hold for the sheet material supply roll. The vertical support members are pivotally mounted to the support frame in order to allow direct engagement of the sheet material supply roll with the feed roll. A self-adjusting braking mechanism is also provided in which a brake strap is mounted about the tapered lateral supports.

2 Claims, 2 Drawing Sheets

FIG. 1
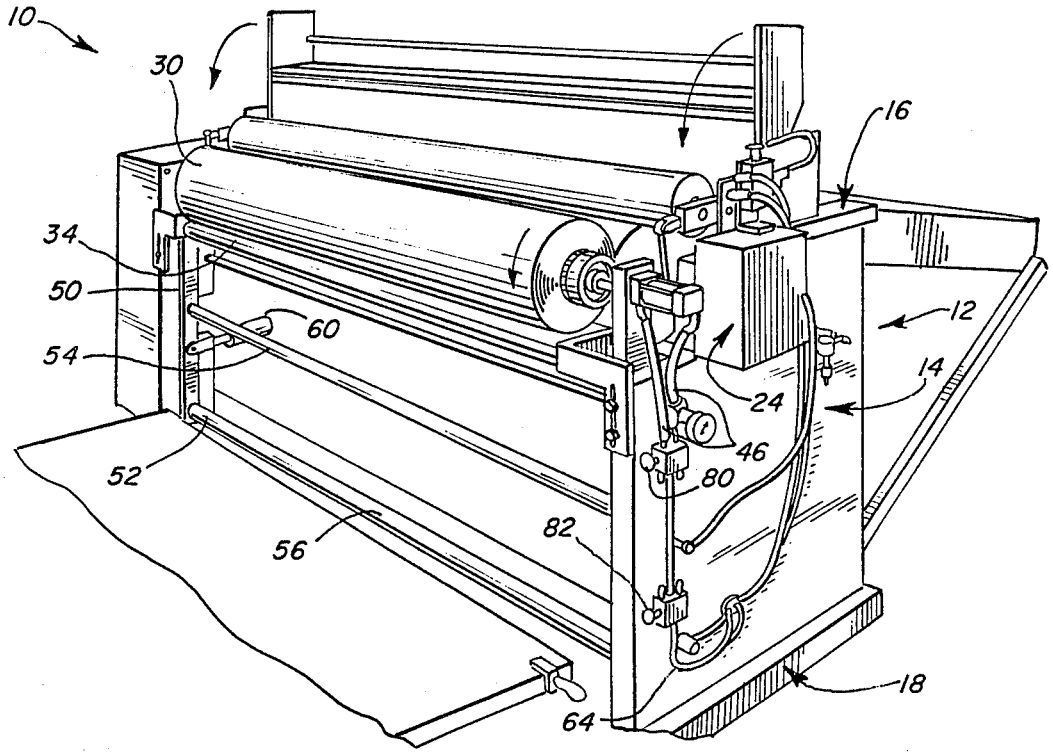
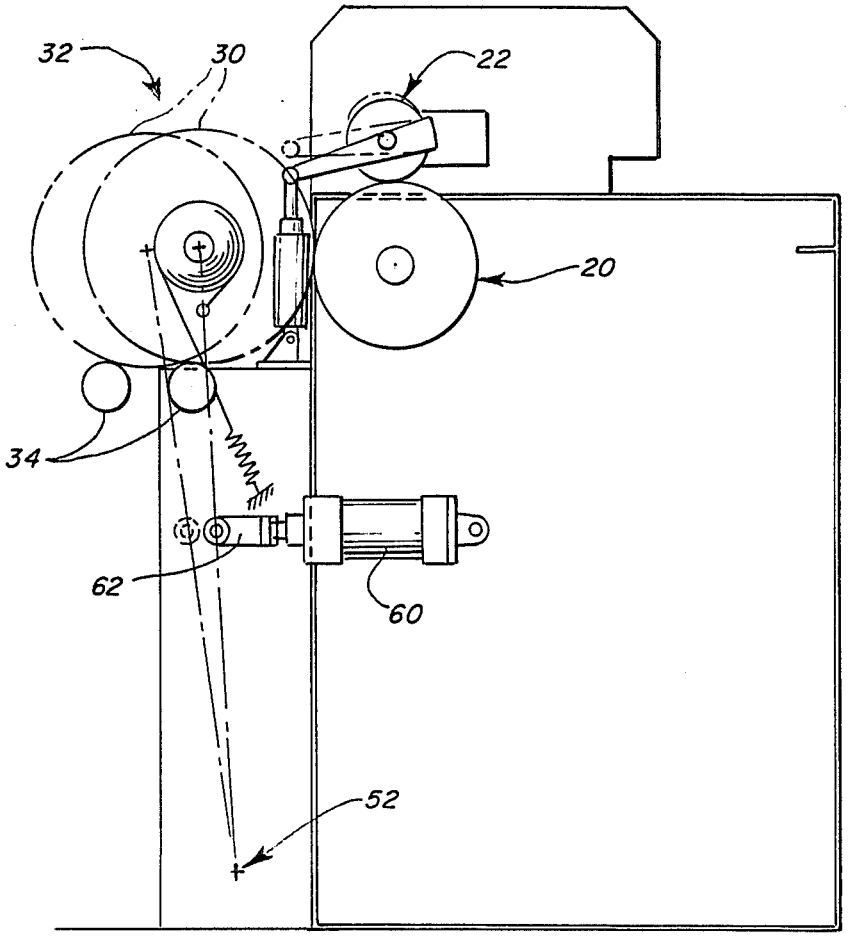
FIG. 2

APPARATUS FOR UNWINDING AND FEEDING MATERIAL INTO A SHEETING MACHINE

BACKGROUND OF THE INVENTION

Reference is made to U.S. Pat. No. 3,760,669 to Ben J. Rosenthal, et al., which describes a sheet material feeding and cutting apparatus or sheeting machine on which the present invention is an improvement.

FIELD OF THE INVENTION

This invention relates to sheet material feeding and cutting devices or sheeting machines and the manner of loading, unwinding and feeding material from supply rolls into the sheeting machine. More particularly, it relates to an improved apparatus for unwinding and feeding sheet material which allows quick loading of the sheet material roll into the machine. One aspect of the apparatus is an improved braking mechanism which is self-adjusting as the diameter of the sheet material supply roll decreases during operation.

DESCRIPTION OF THE PRIOR ART

A variety of sheet material feeding and cutting systems have been developed in which material is fed from a supply roll into a cutting system of a sheeting machine. Such machines usually accommodate a variety of sizes of material supply rolls. The supply roll is set on an unwind shaft and material is unwound and fed into the machine in specified amounts. The unwind of the material is controlled by a dancer bar in conjunction with a braking system. The dancer bar acts against the sheet material between the roll and the feeding location. The dancer maintains tension in the supply roll as the material is unwound. The machine exerts an intermittent pulling force on the material during intermittent advance into the machine.

Typically, a brake mechanism is provided for controlling unwinding rotation of the material supply roll. The brake mechanism is operated under the control of the dancer bar. As the material from the supply roll is wound around the dancer bar and fed into the cutting area, a control on the dancer bar raises and lowers the bar to allow the unwind and feeding operations to occur. Once the desired amount of material has been fed into the machine, and the cutting operation is to occur, the dancer bar is moved downward against the material as the supply roll is stopped.

The movement of the dancer bar typically serves two purposes. A brake band is usually attached to the dancer bar so that the brake band is drawn against the outside of the supply roll upon movement of the dancer bar. This braking system aids the slowing of the movement of the supply roll. A braking system is necessary to counteract the inertia of the moving supply roll. Also, the movement of the dancer bar serves to maintain a tension in the material unwinding from the supply roll and prevent the continuation of the unwind when the feeding operation has stopped.

Various combinations of unwinding, feeding and braking systems for sheeting machines are reflected in the prior art. U.S. Pat. No. 4,441,664 to Stohlquist, for example, discloses a material feed apparatus that includes a brake for controlling unwinding rotation of the web supply roll. The brake is operated under the control of a dancer to decrease the braking action when the material is fed at a rate faster than the rate at which it unwinds from the supply roll. The dancer is constructed and arranged to increase the tension applied to the brake band when the material is fed at a slower rate than the unwind rate from the supply roll. The brake band extends part way around the outside of the supply roll. As the size of the supply roll decreases, the braking action applied by the brake band also decreases. Since the brake band engages the outside of the supply roll, the radius on which the braking action is applied decreases as the diameter of the supply roll decreases.

It is highly desirable to provide an unwind apparatus which is simple and allows quick changeability of supply rolls. The use of the dancer bar in combination with a brake mechanism causes difficulty in loading and unloading rolls. Each time a new or different supply roll of material is needed on the machine, a detailed loading and unwinding procedure is necessary. The material must be wrapped around the dancer bar and into the feeding area. A loading and feeding apparatus is needed in which supply rolls can be loaded quickly without a complicated and lengthy loading procedure, as often found with the inclusion of a dancer roll.

The apparatus of the present invention provides such a quick unwind and loading capability. Actuators operable by simple switches allow the movement of the entire supply roll vertical support system from the loading position to the feeding position. In the loading position, the supply roll is easily loaded into the machine by an operator. In the feeding position, the supply roll is pressed against the feed roll and feeds directly into the machine.

Additional actuators operable by simple switches allow the movement of the lateral support system for the supply roll. The lateral supports are tapered to allow easy insertion into the supply roll. The lateral supports eliminate the need for placing a support bar through the center of the supply roll.

The braking system is wrapped around the lateral support system of the apparatus. The brake strap is fastened between the vertical support, which swings freely, and a spring member. By fastening the spring member to the frame support, the braking system is self-adjusting. As the diameter of the supply roll decreases, the spring is loosened, providing less braking force. In this manner, the braking action is altered.

OBJECTS OF THE INVENTION

It is therefore an object of this invention to provide an improved apparatus for unwinding and feeding sheet material into a sheeting machine which meets the aforenoted needs.

It is a specific object of this invention to provide an apparatus for unwinding and feeding sheet material which allows quick change of material supply rolls.

It is another object of this invention to provide an apparatus for unwinding and feeding sheet material that avoids the disadvantages and complexities of the prior art.

It is another object of this invention to provide an apparatus for unwinding and feeding sheet material which provides an improved braking mechanism which is self-adjusting as the diameter of the sheet material supply roll decreases through unwinding of the sheet material.

Other objects, advantages and features of the present invention will become apparent upon reading the following detailed description and appended claims, and upon reference to the accompanying drawings.

SUMMARY OF THE INVENTION

In accordance with one embodiment of this invention, an improved apparatus for unwinding and feeding sheet material into a sheeting machine which achieves the foregoing objects includes a feeding system for the sheet material. The feeding system includes a feed roll and a drive mechanism coupled to the feed roll. A support frame is provided to support the entire system and, in particular, the vertical support members. Tapered support members provide lateral support for the sheet material supply roll. Vertical support members provide support for the tapered lateral support members. The vertical support members are pivotally mounted to the support frame in order to allow engagement of the sheet material supply roll with the feed roll. A self-adjusting braking mechanism is also provided in which the brake strap is mounted about the tapered lateral supports. One end of the brake strap is attached to the vertical support member while the second end is attached to a spring member. The spring member is attached to the frame support.

DESCRIPTION OF THE DRAWINGS

For a more complete understanding of this invention, reference should be made to the embodiments illustrated in greater detail in the accompanying drawings and described below by way of examples of the invention.

FIG. 1 is a perspective view of the preferred embodiment of the present invention supporting a sheet material supply roll;

FIG. 2 is a side view of the apparatus of FIG. 1 illustrating the location of the material supply roll in the loading and feeding positions.

DETAILED DESCRIPTION OF THE DRAWINGS

Turning now to the drawings, FIG. 1 illustrates generally the improved unwind and feeding apparatus of the present invention at 10. FIG. 1 is a perspective view showing the support frame 12, with sides 14, top 16 and bottom 18.

Figure 3:
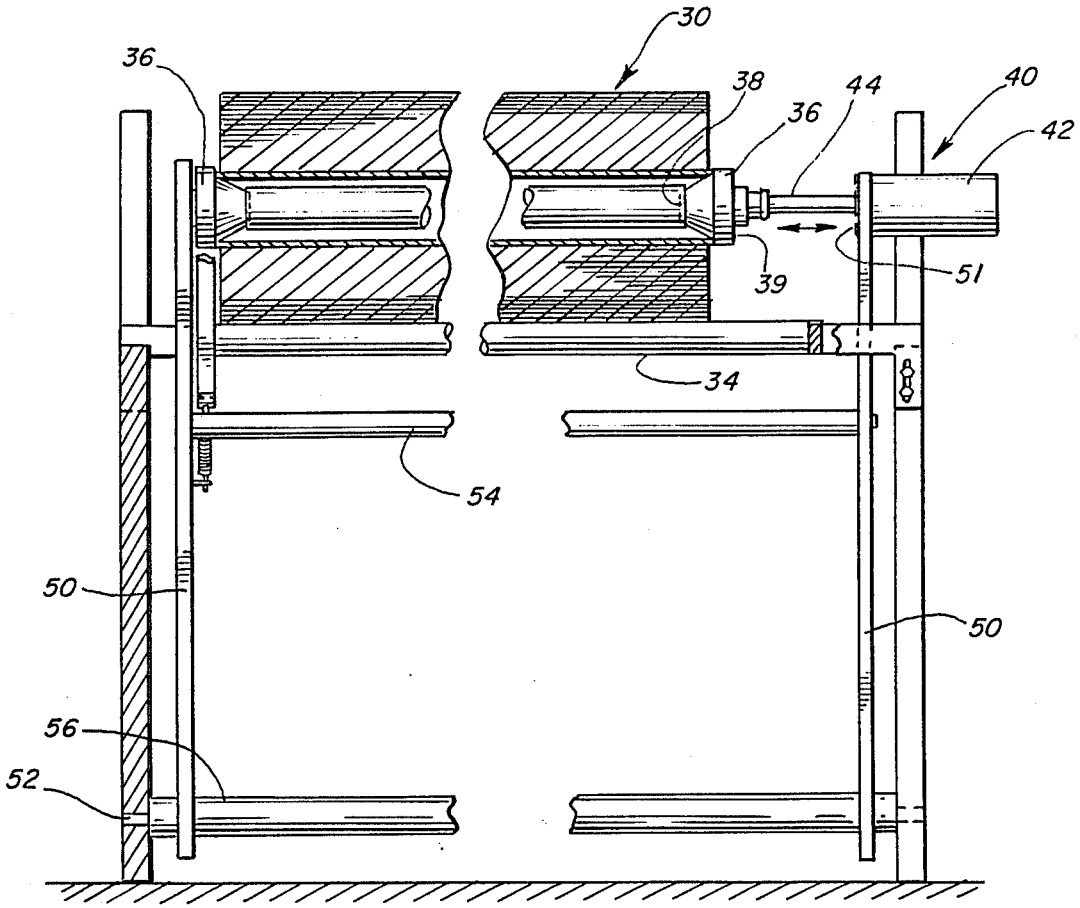
FIG. 3 is a front view of the apparatus of FIG. 1 illustrating the location of the vertical and lateral supports.

The apparatus contains a feeding mechanism, shown more clearly in FIGS. 2 and 3. The feeding mechanism includes a feed roll 20 and pressure roll 22, both which may have rubber surfaces for traction. The pressure roll 22 acts against the feed roll 20. The feed roll is driven by a feed roll drive 24. The feed roll drive is actuated by power means (not shown).

A supply roll of sheet material 30 is provided from which material is fed into the cutting portion of the machine (not shown). The supply roll 30 is held in the loading area 32. Stiff horizontal support bars 34 are provided in the loading area 32 in order to aid the loading operation. The supply roll 30 may be held in the operator's hands prior to loading, or may be rested on the horizontal support bars 34.

Once the supply roll 30 is in the loading area 32, the roll is supported for loading by simple actuation one of the lateral support members 36. The lateral support members are preferably of tapered or conical shape. The front end 38 of the lateral support members 36 fits easily into the end of the supply roll. By coupling the conical lateral support members with the supply roll in this manner, the need for a support bar through the center of the supply roll is eliminated.

The rear end 39 of at least one of the lateral support members is attached to an actuating mechanism 40. The actuating mechanism consists of an air cylinder 42 having an extensible and retractable plunger 44. The plunger is attached to the rear end 39 of the lateral support member 36. Pressurized air is supplied to the air cylinder 42 through a conduit 46 from an air supply (not shown). A switch 80 controls the supply of air through the conduit 46.

The lateral support members are illustrated more clearly in FIG. 3. The lateral support members 36 are cantilevered on a pair of vertical support members 50. The lateral support members and actuating mechanism 40 are coupled to the vertical support members, preferably by bolts 51. The vertical support members 50, in turn, extend downwardly to the frame support, where they are pivotally mounted at pivot connection 52. The pivot connection 52 of the vertical support members allows the vertical support members to swing in and out, toward and away from the feed roll.

The swinging of vertical support members 50 about pivot connection 52 allows the easy loading advantage of the present invention. The vertical support members also provide a sufficient tension on the sheet material to prevent jamming during feeding.

The vertical support members may be formed of bars of rigid steel. Additional cross supports 54, 56 may be provided to add further structural integrity. At least one actuating cylinder 60, is provided to allow movement of the vertical support members around the pivot connection 52. The cylinder drives an extensible and retractable plunger 62 which is coupled to the vertical support member 50. Air conduits 64 allow air supply to the cylinder 60 from a source of compressed air (not shown). The plunger 62 may be connected to the vertical support member at the cross support 54 to minimize the necessary force to pivot the vertical support members. Alternatively, the plunger and cylinder may be connected anywhere along the vertical support member. The cylinder 60 and pivot connection 52 are best illustrated in FIG. 2.

The vertical support members are preferably formed of rigid steel. As an alternative, the vertical support members may be made of flexible steel, or spring steel, forming a flexible link between the pivot connection 52 and the lateral support member. This flexibility will allow the lateral support member to move laterally without the need to have the air cylinder 42 connected to the lateral support member. In this alternative embodiment, the air cylinder 60 may be inserted in cross support 54. The actuating cylinder then acts against the vertical support member 50 to move the vertical support members, and consequently, the lateral support members toward and away from the supply roll.

Figure 4:
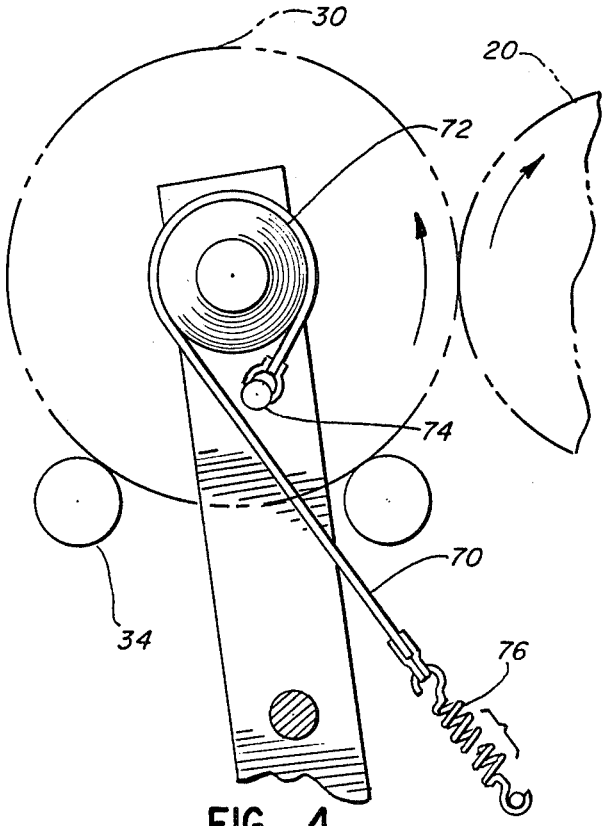
FIG. 4 is a sectional view of the apparatus of FIG. 1 illustrating the braking mechanisms.
Figure 5:
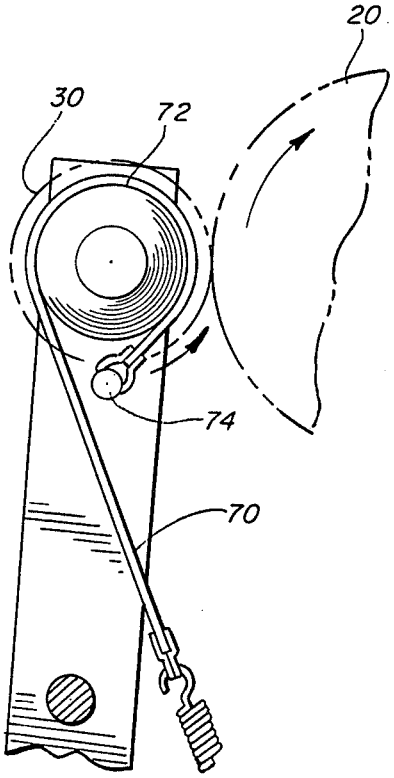
FIG. 5 is a sectional view illustrating the brake mechanism when the diameter of the supply roll has decreased.

The novel auxiliary braking system of the invention is shown most clearly in FIGS. 4 and 5. The auxiliary braking system comprises brake strap 70 which contacts brake surface 72. The brake surface 72 is along the outside portion of the lateral support member. The brake strap wraps around the lateral support member and contacts the brake surface 72. One end of the brake strap 70 is connected to vertical support member 50 at connection point 74 which is located on the vertical support at a point below the lateral support member. The second end of the brake strap 70 is connected to a spring mechanism 76. The spring mechanism 76 is in turn attached to a point on the support frame.

The apparatus of the present invention greatly simplifies the loading and unwinding of sheet material from a supply roll. Actuation of the switch 82 allows air to flow through the conduit 64 to air cylinder 60. Pressurized air in the air cylinder 60 forces the extensible and retractable plunger 62 to move, causing movement of vertical support member 50. Thus, closing and opening switch 82 controls movement of the vertical support member 50 from an open position to a closed position and vice versa.

In the open or loading position, the loading of the sheet material supply roll 30 is possible. The supply roll is set on horizontal support bars 34. Once in this position, the switch 80 is actuated which controls the air supply to air actuation cylinder. Upon closing switch 80, the air travels from the source of compressed air through the conduits 46 into the air cylinder 42. Air in the cylinder actuates the extensible and retractable plunger which causes movement of the lateral support member 36. Thus, closing switch 80 causes closure of the lateral support member into the supply roll. The tapered lateral support members easily fit into the sheet material supply roll ends.

After the lateral support members are inserted into the sides of the supply roll 30, the switch 82 may be activated to cause movement of the vertical support members into the closed position. In the closed position, the supply roll sits against the feed roll. In this position, driving the feed roll causes movement of the supply roll. Material from the supply roll is fed between the pressure roll and the feed roll. In this manner, the material is easily unwound.

As is well-known in the sheeting machine art, the material is unwound and the machine determines that a stopping action is necessary for cutting. The machine braking action assists stopping and maintains tension in the supply roll. While the stopping of the feed roll essentially stops the supply roll movement, the inertia of supply roll continues the movement and associated unwinding of the supply roll. At this point, the auxiliary braking system which includes the braking strap acting on the braking surface aids the stopping of the supply roll and prevents further unwind of the supply roll. The auxiliary braking system thus minimizes the continued turning of the supply roll. This auxiliary system also provides an additional tension during start-up by resisting movement of the supply roll.

The auxiliary braking system of this invention has a further self-adjusting feature. As the supply roll unwinds and its diameter decreases, the tension of the brake adjusts. This adjustment occurs because the brake is mounted around the lateral support member and attached to the vertical support member and, through a spring, to the frame support. When the diameter of the supply roll is large, the spring stretches a greater distance and provides a greater force on the brake strap. As the diameter of the supply roll decreases, the spring loosens which provides less force and decreases the braking action. Thus, the location and attachment points of the brake member allows a self adjusting braking system as the supply roll diameter decreases.

Thus an improved apparatus for unwinding and feeding sheet material has been provided which meets the aforestated objects. The apparatus allows quick and simple unwind and loading into the sheet material feeding and cutting machine. Further an improved braking system is self adjusting.

What is claimed is:

1. A sheeting machine having means for receiving material from a supply roll of sheet material, drive means connected to the receiving means for causing the receiving means to rotate, frame means connected to the receiving means, and a delivery means for feeding the material from the supply roll into the receiving means, the delivery means comprising:

lateral support means for holding said supply roll of sheet material in position to be fed into said receiving means, said lateral support means including a tapered right lateral support member and a tapered left lateral support member; means for actuating at least one of said right and left lateral support members;

vertical support means connected to said lateral support means and pivotally connected to said frame means for moving said lateral support means into proper position to feed said supply roll of sheet material into said receiving means and providing sufficient tension on said sheet supply roll to prevent jamming, said vertical support means including a right vertical support member attached to said frame means at a first pivot connection and said vertical support means including a left vertical support member attached to said frame means at a second pivot connection;

said lateral support means including a plurality of horizontal support bars interposed between said right and left vertical support members;

control means connected to said vertical support means for pivoting said vertical support means into and out of said proper position to feed said supply roll, said control means including means for positioning said supply roll directly against said receiving means and maintaining said supply roll directly against said receiving means as the diameter of the supply roll decreases during use; and braking means for slowing movement of said sheet material supply roll and maintaining the proper tension of said sheet material supply roll as the diameter of the supply roll decreases during use, said braking means connected around said lateral support means and between said vertical support means and said frame means.

2. A sheeting machine having means for receiving material from a supply roll of sheet material, drive means connected to the receiving means for causing the receiving means to rotate, frame means connected to the receiving means, a delivery means for feeding the material from the supply roll into the receiving means, the delivery means comprising:

lateral support means for holding said supply roll of sheet material in position to be fed into said receiving means;

vertical support means connected to said lateral support means and pivotally connected to said frame means for moving said lateral support means into proper position to feed said supply roll of sheet material into said receiving means and providing sufficient tension on said sheet supply roll to prevent jamming; and, braking means connected between said lateral support means, said vertical support means and said frame means, for slowing movement of said sheet material supply roll and maintaining the proper tension of said sheet material of said supply roll as the diameter of the supply roll decreases during use, said braking means comprises a braking member having a first and second end segment, the first end segment of said braking member connected to said vertical support means; the second end of said braking member connected to said support frame means; and, a portion of said braking member between said first and second end segments contacting the surface along the outer periphery of said lateral support means for providing braking action of the supply roll as the braking member acts against the outer periphery of said lateral support means.

* * * * *